US008491338B1

(12) United States Patent
Lin et al.

(10) Patent No.: US 8,491,338 B1
(45) Date of Patent: Jul. 23, 2013

(54) BATTERY CONNECTOR

(75) Inventors: Chih-Chiang Lin, Taipei (TW); Ta-Chih Yu, Taipei (TW)

(73) Assignee: Proconn Technology Co., Ltd., New Taipei (TW)

( * ) Notice: Subject to any disclaimer, the term of this patent is extended or adjusted under 35 U.S.C. 154(b) by 0 days.

(21) Appl. No.: 13/478,738

(22) Filed: May 23, 2012

(51) Int. Cl.
*H01R 24/00* (2011.01)

(52) U.S. Cl.
USPC ..... 439/627; 439/500

(58) Field of Classification Search
USPC ..... 439/500, 289, 627, 824, 700
See application file for complete search history.

(56) References Cited

U.S. PATENT DOCUMENTS 6,814,626 B2 * 11/2004 Wen-Yao ..... 439/700
6,923,690 B1 * 8/2005 Wang ..... 439/500
7,077,709 B1 * 7/2006 Shin-Ting ..... 439/289
7,134,878 B2 * 11/2006 Zheng et al. ..... 439/65
7,815,474 B1 * 10/2010 Lin et al. ..... 439/700
8,353,730 B1 * 1/2013 Wang et al. ..... 439/700
2005/0026510 A1 * 2/2005 Orihara ..... 439/700
2005/0042938 A1 * 2/2005 Zheng et al. ..... 439/824

* cited by examiner

*Primary Examiner* — Briggitte R Hammond
(74) *Attorney, Agent, or Firm* — WPAT, P.C.; Anthony King

(57) ABSTRACT

A battery connector includes an insulating housing, a plurality of contact terminals, conductive terminals and elastic elements which are disposed to the insulating housing. Each elastic element is restricted between the contact terminal and the conductive terminal. The insulating housing defines a plurality of terminal cavities and two inserting slots. Each contact terminal has two resisting arms slidably located in the inserting slots. Each resisting arm protrudes downward to form an abutting arm located in the terminal cavity. Each conductive terminal has two connecting slices inserted in the inserting slots, and a holding slice stretching in the terminal cavity. An electrical connection is realized between the contact terminal and the corresponding conductive terminal by means of the resisting arms electrically abutting against the corresponding connecting slices and the abutting arms electrically clamping the holding slice therebetween under the bias of the connecting slices acting on the resisting arms.

8 Claims, 3 Drawing Sheets

BATTERY CONNECTOR

BACKGROUND OF THE INVENTION

1. Field of the Invention

The present invention generally relates to a battery connector, and more particularly to a battery connector capable of electrically connecting with a battery.

2. The Related Art

In general, a battery connector includes an insulating housing, a plurality of contact terminals, a plurality of conductive terminals and a plurality of elastic elements. The insulating housing defines a plurality of terminal cavities of which each penetrates through a rear surface thereof, and a plurality of receiving grooves of which each penetrates through a front surface thereof and communicates with the terminal cavity. Each contact terminal has a base arm, a touching arm connecting with a front of the base arm, and two resisting arms connecting with two sides of a rear of the base arm. Each conductive terminal has a restricting slice, two connecting slices bending forward from two opposite sides of the restricting slice, and a soldering slice connecting with a bottom of the restricting slice. When the battery connector is assembled, each conductive terminal is received in the terminal cavity with the soldering slice thereof projecting out of the insulating housing, and each contact terminal is disposed to the receiving groove with the resisting arms thereof resisting against the connecting slices for realizing an electric contact and conduction between the contact terminal and the conductive terminal of the battery connector. The touching arms of the contact terminals project out of the receiving grooves to electrically connect with a battery.

However, the contact terminal is apt to disconnect from the conductive terminal to cause a sudden interruption of electric power when the battery connector is shaken. As a result, it makes the electric contact between the contact terminal and the conductive terminal of the battery connector unsteady.

SUMMARY OF THE INVENTION

An object of the present invention is to provide a battery connector which includes an insulating housing, a plurality of contact terminals, a plurality of conductive terminals and a plurality of elastic elements. The insulating housing has a front surface and a rear surface opposite to the front surface. The insulating housing defines a plurality of terminal cavities penetrating through the rear surface and receiving grooves penetrating through the front surface and connecting with the terminal cavities respectively. Two opposite inner sidewalls of each terminal cavity are recessed oppositely to form two inserting slots passing through the rear surface. The contact terminals are movably disposed to the insulating housing. Each contact terminal has a base frame movably located in the receiving groove. A front end of the base frame is defined as a touching portion projecting out of the insulating housing through the receiving groove. Rear ends of two opposite sides of the base frame extend rearward and are further arched oppositely to form two resisting arms slidably located in the inserting slots. A free end of each resisting arm protrudes downward to form an abutting arm located in the terminal cavity. The conductive terminals are disposed to the insulating housing. Each conductive terminal has a restricting slice against the rear surface. Two opposite sides of the restricting slice bend forward to form two connecting slices inserted in the inserting slots. A bottom of the restricting slice bends forward to form a holding slice stretching in the terminal cavity. A rear end of the conductive terminal defines a soldering slice projecting out of the insulating housing. An electrical connection is realized between the contact terminal and the corresponding conductive terminal by means of the resisting arms electrically abutting against the corresponding connecting slices and the abutting arms electrically clamping the holding slice therebetween under the bias of the connecting slices acting on the resisting arms. Each elastic element is located in the terminal cavity and restricted between the contact terminal and the conductive terminal.

As described above, the battery connector maintains a steady electric contact between the contact terminal and the conductive terminal by virtue of a battery pressing against the touching portion of the contact terminal for pushing the contact terminal to move rearward so as to compress the elastic element and keep the resisting arms electrically abutting against the corresponding connecting slices and the abutting arms electrically clamping the holding slice therebetween under the bias of the connecting slices acting on the resisting arms. Thus, it effectively prevents the contact terminal from disconnecting from the conductive terminal to cause a sudden interruption of electric power when the battery connector is shaken. Moreover, the battery connector may generate a larger normal force by virtue of the resisting arms interfering with the connecting slices, the abutting arms interfering with the holding slice, and the elastic element being compressed between the contact terminal and the conductive terminal.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
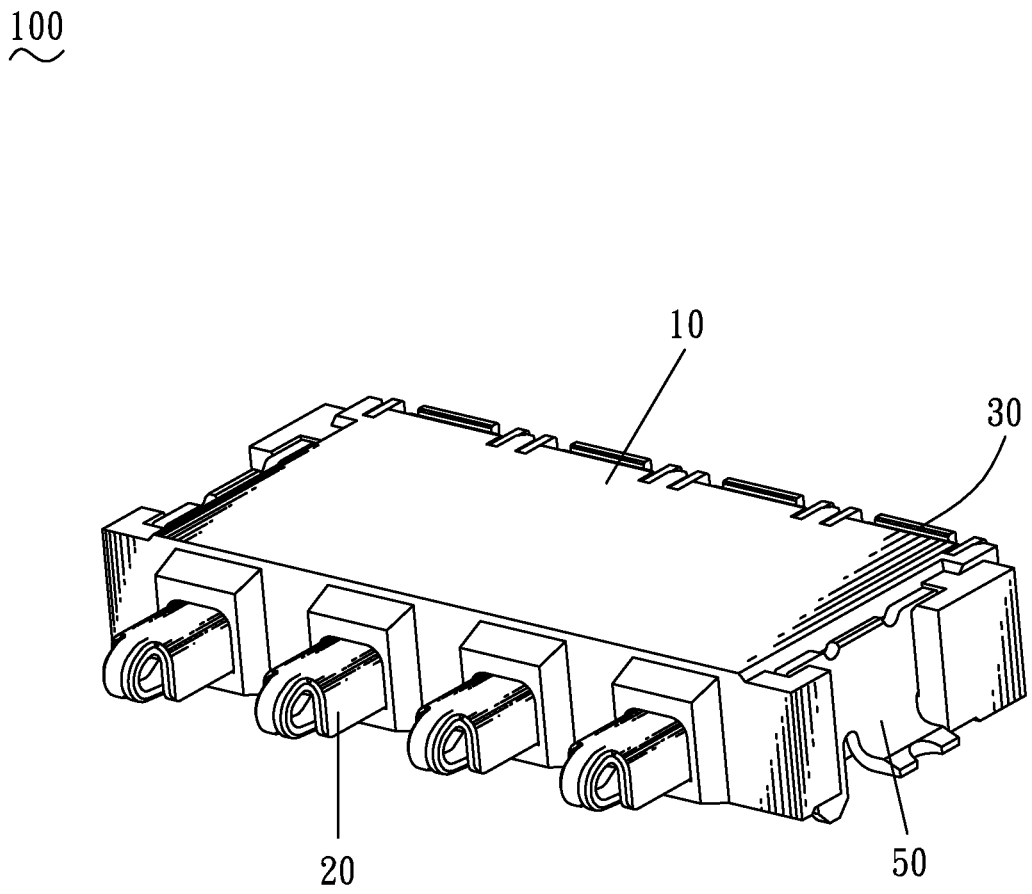
FIG. 1 is a perspective view of a battery connector in accordance with the present invention.
Figure 2:
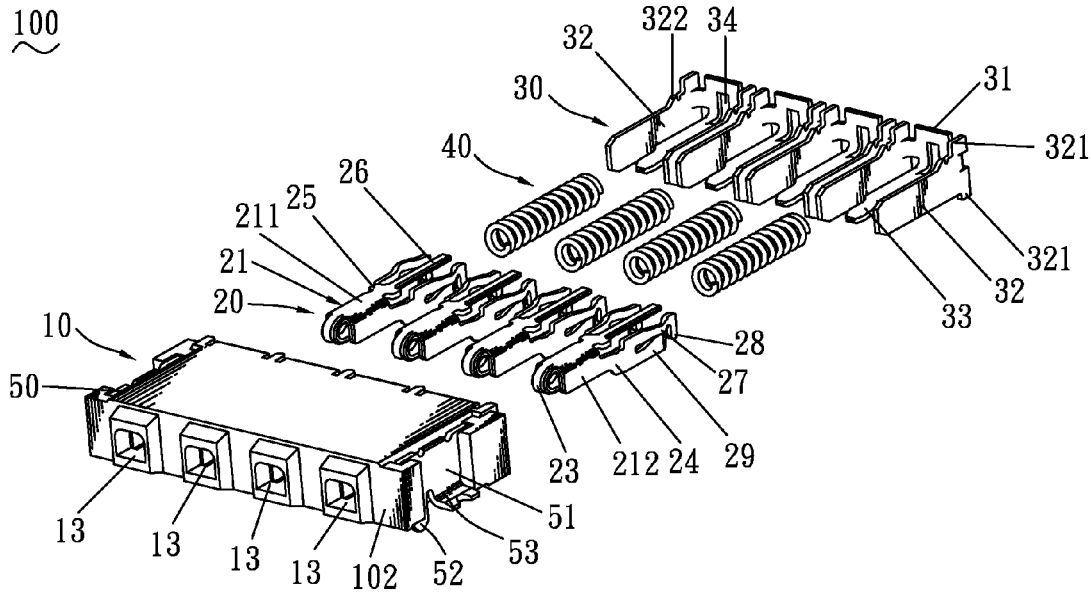
FIG. 2 is a partially exploded view of the battery connector of FIG. 1.

With reference to FIG. 1 and FIG. 2, a battery connector 100 in accordance with the present invention is shown. The battery connector 100 includes an insulating housing 10, a plurality of contact terminals 20, a plurality of conductive terminals 30, a plurality of elastic elements 40 and a pair of supporting elements 50.

Figure 3:
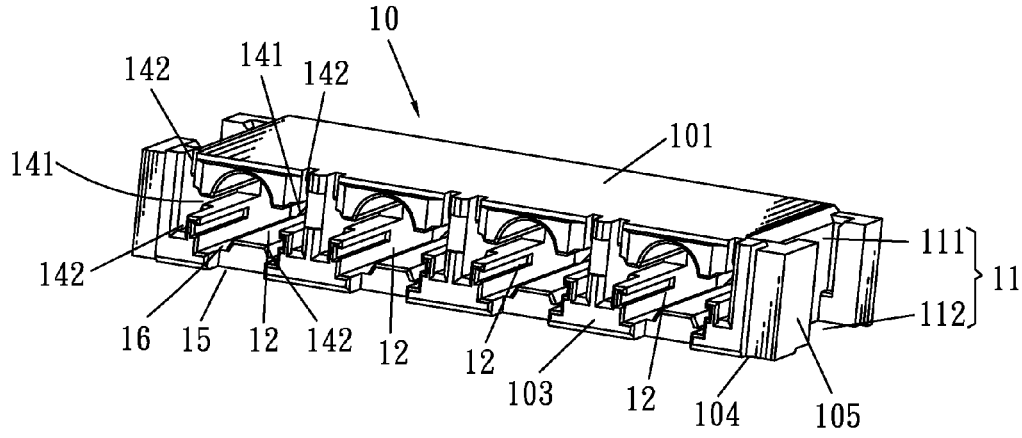
FIG. 3 is a perspective view of an insulating housing of the battery connector of FIG. 2.

Referring to FIG. 2 and FIG. 3, the insulating housing 10 of a rectangular shape has a top surface 101, a front surface 102 perpendicular to the top surface 101, a rear surface 103 opposite to the front surface 102, a bottom surface 104 opposite to the top surface 101, and two opposite side surfaces 105 connecting with the top surface 101, the front surface 102, the rear surface 103 and the bottom surface 104. Two opposite ends of the insulating housing 10 respectively define a fixing slot 111 extending longitudinally and penetrating through the top surface 101, and a receiving channel 112 connecting with a middle of the fixing slot 111 and passing through the corresponding bottom surface 104 and side surface 105. The fixing slot 111 and the receiving channel 112 together define a holding groove 11.

Referring to FIG. 2 and FIG. 3 again, the insulating housing 10 defines a plurality of terminal cavities 12 arranged at regular intervals along a transverse direction thereof. Each terminal cavity 12 penetrates through the rear surface 103 and extends towards the front surface 102. The insulating housing 10 defines a plurality of receiving grooves 13 each of which penetrates through the front surface 102 and connects with a middle of a front of the terminal cavity 12. Two opposite inner sidewalls of each terminal cavity 12 are recessed oppositely to form two inserting slots 141 passing through the rear surface 103. Two opposite sides of a rear end of the inserting slot 141 are further concaved oppositely to form two fastening fillisters 142. A rear end of a bottom sidewall of the terminal cavity 12 is recessed forward to form a gap 15. Two opposite sides of the bottom sidewall of the terminal cavity 12 are recessed downward to form two locating slots 16.

Figure 4:
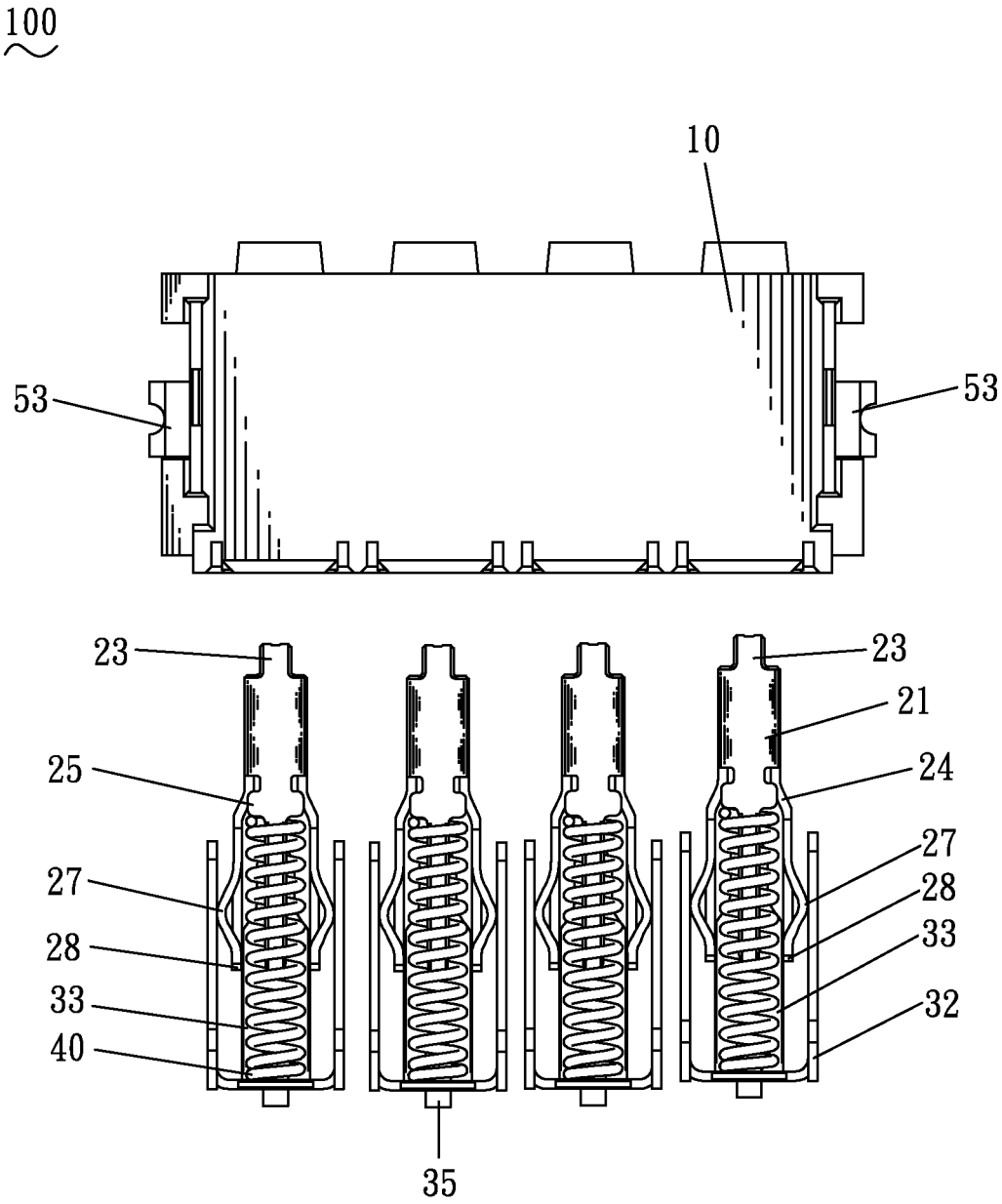
FIG. 4 is another partially exploded view of the battery connector of FIG. 1.

Referring to FIG. 2 and FIG. 4, each of the contact terminals 20 has a base frame 21. The base frame 21 includes a base arm 211 located at a top thereof. Two opposite sides of the base arm 211 extend downward to form two propping arms 212. A front end of the base arm 211 is arced forward and then bent rearward to form a touching portion 23 with a free end thereof being located between the two propping arms 212. A rear end of the base arm 211 extends rearward to form a locating piece 25 of which a middle of a rear extends rearward to form an elongated guiding pin 26. A rear end of each propping arm 212 meanders rearward and outward to form a stretching arm 24. Two tops of two rears of the two stretching arms 24 protrude upward, then extend rearward and are further arched oppositely to form two arc-shaped resisting arms 27. The guiding pin 26 is substantially located between the two resisting arms 27. A free end of each resisting arm 27 protrudes downward to form an abutting arm 28. A bottom of the rear of each stretching arm 24 extends rearward to form a fastening arm 29.

Referring to FIG. 2 and FIG. 4, each of the conductive terminals 30 has a restricting slice 31. Two opposite sides of the restricting slice 31 bend forward to form two connecting slices 32. Two rears of a top edge and a bottom edge of each connecting slice 32 protrude oppositely to form two wedging portions 321. A bottom of the restricting slice 31 bends forward to form a holding slice 33. A rear end of the conductive terminal 30 defines an L-shaped opening 34 passing through the restricting slice 31 and the holding slice 33. A lower inner sidewall of the opening 34 bends downward and then rearward to form a soldering slice 35 of L shape. The top edge of each connecting slice 32 protrudes upward to form an interfering portion 322.

Referring to FIG. 2 and FIG. 4, each of the supporting element 50 has a rectangular fixing plate 51. One end of a bottom of the fixing plate 51 extends downward to form an inserting strip 52. A middle of the bottom of the fixing plate 51 bends horizontally to form a soldering strip 53. In this embodiment, the elastic element 40 is a spring.

Referring to FIG. 1, FIG. 2, FIG. 3 and FIG. 4, when the battery connector 100 is assembled, each of the contact terminals 20 is movably disposed to the insulating housing 10. The base arm 211 and the propping arms 212 of the base frame 21 are movably located in the receiving groove 13. The touching portion 23 projects out of the insulating housing 10 through the receiving groove 13. The fastening arms 29 are located in the locating slots 16. The stretching arms 24 are located in the terminal cavity 12. The resisting arms 27 are slidably located in the inserting slots 141. The abutting arms 28 are located in the terminal cavity 12. The locating piece 25 and the guiding pin 26 are located in the terminal cavity 12. Then the elastic element 40 is located in the terminal cavity 12 and worn around the guiding pin 26 of the contact terminal 20.

At last, the conductive terminal 30 is inserted forward into the insulating housing 10 until the restricting slice 31 is against the rear surface 103. In the meanwhile, the connecting slices 32 are inserted in the inserting slots 141. The wedging portions 321 are fastened to the fastening fillisters 142 and the interfering portions 322 interfere with top inner sidewalls of the fastening fillister 142 for firmly restricting the conductive terminal 30 to the insulating housing 10. The holding slice 33 stretches in the terminal cavity 12 and is located under the elastic element 40. The soldering slice 35 projects out of the insulating housing 10 from the gap 15. An electrical connection is realized between the contact terminal 20 and the corresponding conductive terminal 30 by means of the resisting arms 27 electrically abutting against the corresponding connecting slices 32 and the abutting arms 28 electrically clamping the holding slice 33 therebetween under the bias of the connecting slices 32 acting on the resisting arms 27. The elastic element 40 is restricted between the locating piece 25 and the restricting slice 31 of the conductive terminal 30.

Referring to FIGS. 1-4, in use, when a battery is connected with the battery connector 100, the battery presses against the touching portion 23 of the contact terminal 20 for pushing the contact terminal 20 to move rearward so as to compress the elastic element 40. In a movement process of the contact terminal 20, the resisting arms 27 of the contact terminal 20 keep electrically abutting against the corresponding connecting slices 32 of the conductive terminal 30 and the abutting arms 28 of the contact terminal 20 keep electrically clamping the holding slice 33 of the conductive terminal 30 therebetween under the bias of the connecting slices 32 of the conductive terminal 30 acting on the resisting arms 27 of the contact terminal 20 to maintain a steady electric contact and conduction between the contact terminal 20 and the conductive terminal 30. Moreover, the battery connector 100 may generate a larger normal force by virtue of the resisting arms 27 interfering with the connecting slices 32, the abutting arms 28 interfering with the holding slice 33, and the elastic element 40 being compressed between the locating piece 25 of the contact terminal 20 and the restricting slice 31 of the conductive terminal 30.

As described above, the battery connector 100 maintains the steady electric contact between the contact terminal 20 and the conductive terminal 30 by virtue of the battery pressing against the touching portion 23 of the contact terminal 20 for pushing the contact terminal 20 to move rearward so as to compress the elastic element 40 and keep the resisting arms 27 electrically abutting against the corresponding connecting slices 32 and the abutting arms 28 electrically clamping the holding slice 33 therebetween under the bias of the connecting slices 32 acting on the resisting arms 27. Thus, it effectively prevents the contact terminal 20 from disconnecting from the conductive terminal 30 to cause a sudden interruption of electric power when the battery connector 100 is shaken. Moreover, the battery connector 100 may generate the larger normal force by virtue of the resisting arms 27 interfering with the connecting slices 32, the abutting arms 28 interfering with the holding slice 33, and the elastic element 40 being compressed between the locating piece 25 of the contact terminal 20 and the restricting slice 31 of the conductive terminal 30.

What is claimed is:

1. A battery connector, comprising:

an insulating housing having a front surface and a rear surface opposite to the front surface, the insulating housing defining a plurality of terminal cavities penetrating through the rear surface and receiving grooves penetrating through the front surface and connecting with the terminal cavities respectively, two opposite inner sidewalls of each terminal cavity being recessed oppositely to form two inserting slots passing through the rear surface;

a plurality of contact terminals movably disposed to the insulating housing, each contact terminal having a base frame movably located in the receiving groove, a front end of the base frame being defined as a touching portion projecting out of the insulating housing through the receiving groove, rear ends of two opposite sides of the base frame extending rearward and being further arched oppositely to form two resisting arms slidably located in the inserting slots, a free end of each resisting arm protruding downward to form an abutting arm located in the terminal cavity;

a plurality of conductive terminals disposed to the insulating housing, each conductive terminal having a restricting slice against the rear surface, two opposite sides of the restricting slice bending forward to form two connecting slices inserted in the inserting slots, a bottom of the restricting slice bending forward to form a holding slice stretching in the terminal cavity, a rear end of the conductive terminal defining a soldering slice projecting out of the insulating housing, an electrical connection being realized between the contact terminal and the corresponding conductive terminal by means of the resisting arms electrically abutting against the corresponding connecting slices and the abutting arms electrically clamping the holding slice therebetween under the bias of the connecting slices acting on the resisting arms; and a plurality of elastic elements of which each is located in the terminal cavity and restricted between the contact terminal and the conductive terminal.

2. The battery connector as claimed in claim 1, wherein two opposite sides of a rear end of the inserting slot are further concaved oppositely to form two fastening fillisters, two rears of a top edge and a bottom edge of each connecting slice protrude oppositely to form two wedging portions fastened to the fastening fillisters, the top edge of each connecting slice protrudes upward to form an interfering portion interfering with a top inner sidewall of the fastening fillister.

3. The battery connector as claimed in claim 1, wherein the base frame includes a base arm, two opposite sides of the base arm extend downward to form two propping arms, the base arm and the propping arms are movably located in the receiving groove, a front end of the base arm is arced forward and then bent rearward to form the touching portion, rear ends of the propping arms extend rearward and are further arched oppositely to form the resisting arms.

4. The battery connector as claimed in claim 3, wherein the rear end of each propping arm meanders rearward and outward to form a stretching arm located in the terminal cavity, a top of a rear of each stretching arm protrudes upward and then extends rearward to form the resisting arm.

5. The battery connector as claimed in claim 4, wherein a bottom of the rear of each stretching arm extends rearward to form a fastening arm, two opposite sides of a bottom sidewall of the terminal cavity are recessed downward to form two locating slots for locating the fastening arms therein.

6. The battery connector as claimed in claim 1, wherein a rear end of a bottom sidewall of the terminal cavity is recessed forward to form a gap, the rear end of the conductive terminal defines an L-shaped opening passing through the restricting slice and the holding slice, a lower inner sidewall of the opening bends downward and then rearward to form the soldering slice of L shape projecting out of the insulating housing from the gap.

7. The battery connector as claimed in claim 1, wherein the elastic element is a spring.

8. The battery connector as claimed in claim 7, wherein a rear end of a top of the base frame extends rearward to form a locating piece, a rear of the locating piece extends rearward to form a guiding pin substantially located between the resisting arms, the elastic element is worn around the guiding pin of the contact terminal and restricted between the locating piece and the restricting slice of the conductive terminal.

* * * * *